US007866401B2

(12) United States Patent
McCalvin

(10) Patent No.: US 7,866,401 B2
(45) Date of Patent: Jan. 11, 2011

(54) SAFETY VALVE FOR USE IN AN INJECTION WELL

(75) Inventor: David E. McCalvin, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1362 days.

(21) Appl. No.: 10/905,859

(22) Filed: Jan. 24, 2005

(65) Prior Publication Data

US 2006/0162932 A1 Jul. 27, 2006

(51) Int. Cl.
*E21B 34/08* (2006.01)

(52) U.S. Cl. ..... 166/374; 166/386; 166/305.1; 166/323; 166/332.8

(58) Field of Classification Search ..... 166/374, 166/386, 321, 323, 332.8, 319, 325, 305.1
See application file for complete search history.

(56) References Cited

U.S. PATENT DOCUMENTS

| | | | | |
|---|---|---|---|---|
| 3,786,865 | A | 1/1974 | Tausch et al. | |
| 4,449,587 | A | 5/1984 | Rodenberger et al. | |
| 4,601,342 | A * | 7/1986 | Pringle | 166/323 |
| 4,621,695 | A | 11/1986 | Pringle | |
| 4,624,315 | A * | 11/1986 | Dickson et al. | 166/323 |
| 4,890,674 | A * | 1/1990 | Le | 166/319 |
| 5,190,106 | A | 3/1993 | Johnston | |
| 6,003,605 | A | 12/1999 | Dickson et al. | |
| 6,237,693 | B1 | 5/2001 | Deaton | |
| 6,302,210 | B1 | 10/2001 | Crow et al. | |
| 6,513,594 | B1 | 2/2003 | McCalvin et al. | |
| 6,866,101 | B2 | 3/2005 | Sloan | |
| 6,880,641 | B2 | 4/2005 | Dennistoun et al. | |
| 2004/0154803 | A1 | 8/2004 | Anderson et al. | |

FOREIGN PATENT DOCUMENTS

| | | |
|---|---|---|
| GB | 2345075 A | 6/2000 |
| GB | 2394974 A | 5/2004 |
| GB | 2398311 A | 8/2004 |

* cited by examiner

*Primary Examiner*—David J Bagnell
*Assistant Examiner*—D. Andrews
(74) *Attorney, Agent, or Firm*—Brandon S. Clark; Rodney Warfford

(57) ABSTRACT

The present invention provides for a valve to allow injection of fluids into a well or other subterranean facility. The valve comprises a housing and a flow tube assembly disposed in the housing. A restrictor is joined with the flow tube to restrict flow through the flow tube. A seal element also is positioned to selectively prevent production or upward flow of fluids through the valve upon halting injection operations.

19 Claims, 3 Drawing Sheets

SAFETY VALVE FOR USE IN AN INJECTION WELL

BACKGROUND OF THE INVENTION

1. Field of Invention

The present invention pertains to safety valves used in wells, and particularly to subsurface safety valves used in injection wells or storage facilities related to hydrocarbon production and processing operations.

2. Related Art

Subsurface safety valves are used in wells to prevent the uncontrolled flow of well fluids to the surface. A typical surface controlled subsurface safety valve has a hydraulic control line that supplies hydraulic pressure to the safety valve. So long as an appropriate level of hydraulic pressure is applied, the valve is held in its open state, allowing flow of fluids through the valve. When the pressure is removed or reduced below the required level, the valve moves to its default closed state, preventing flow of fluids through the valve.

Injection wells are typically used to improve production flow in neighboring wells, for storage of hydrocarbons, or for disposal of unwanted byproducts of hydrocarbon production activities (e.g., salt water). By injecting fluids such as water, for example, formation fluids may be displaced into neighboring wellbores so those formation fluids can be recovered. Injection wells may also be used to inject gas or chemicals. It is often desirable to include a safety valve in an injection well to prevent undesired production of fluids when no injection is being performed.

SUMMARY

The present invention provides for a valve to allow injection of fluids into a well or other subterranean facility, but will close to prevent production or upward flow of fluids through the valve upon halting injection operations.

Advantages and other features of the invention will become apparent from the following description, drawings, and claims.

DETAILED DESCRIPTION

Figure 1:
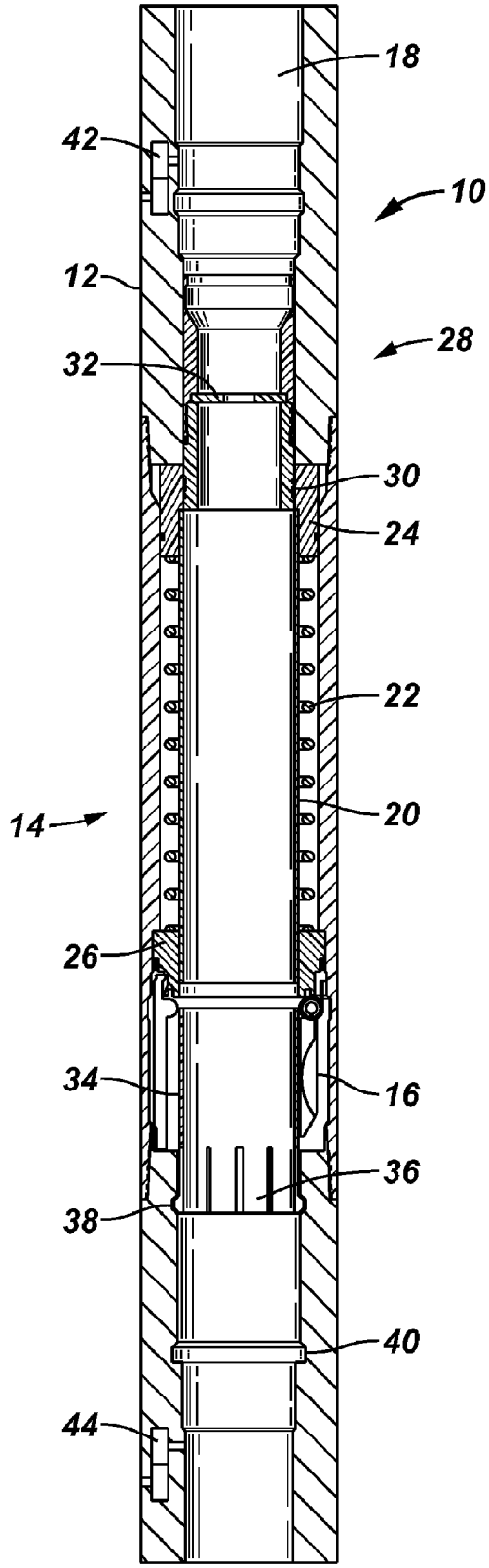
FIG. 1 is a schematic view of a valve constructed in accordance with the present invention, shown in its run-in position.

Referring to FIG. 1, a valve 10 comprises a housing 12, a flow tube assembly 14, and a seal element 16.

Housing 12 has a central passageway 18 and is adapted to join to tubing (not shown) on each of its ends such that the tubing interior and central passageway 18 form a continuous flow path.

Flow tube assembly 14 is disposed within housing 12 and comprises a flow tube 20 axially aligned with central passageway 18. A spring 22 is carried on the outer surface of flow tube 20 and is axially aligned with flow tube 20, but flow tube 20 is free to move within the coils of spring 22. An upper end of spring 22 bears on an upper shoulder 24 fixed to an upper end of flow tube 20, and a lower end of spring 22 bears on a lower shoulder 26 fixed to housing 12 near seal element 16.

Flow tube assembly 14 further comprises a restrictor 28, sometimes referred to in the art as a "bean" or "orifice". In the embodiment shown, restrictor 28 is removeably mounted to upper shoulder 24 and preferably has seals 30 to seal against the inner surface of upper shoulder 24. Restrictor 28 may be variously mounted to upper shoulder 24. For example, restrictor 28 may engage a profile in the inner surface of upper shoulder 24, be fixed to upper shoulder 24 by shear pins (not shown), or abuttingly engage the upper end of flow tube 20. Restrictor 28 may, in an alternative embodiment, be removeably mounted to housing 12. Restrictor 28 has a flow restriction 32 that limits the volumetric flow rate of fluid through central passageway 18. Flow restriction 32 may be, for example, an orifice or a narrowed passageway.

Seal element 16 is mounted to housing 12 or, alternatively, to lower shoulder 26. Seal element 16 is preferably a flapper, as shown in FIG. 1, but other types of seal elements may be used if appropriate allowances or accommodations are made in valve 10. In the embodiment shown, seal element 16 is rotatably mounted to lower shoulder 26. Seal element 26 is biased to move to or remain in its closed state.

A lock 34 is movably disposed in housing 12. Lock 34 is initially placed in an upper position to hold seal element 16 in its open state. In the embodiment shown, lock 34 has a collet 36 that releasably engages an upper profile 38 in housing 12. Housing 12 also has a lower profile 40 that collet 36 can engage to constrain lock 34 in a lower position. Other retaining devices may be used to secure lock 34 in the upper and lower positions. Lock 34 has an interior passageway so as to not interfere with fluid flow or mechanical intervention through central passageway 18. Lock 34 may be variously actuated. For example, lock 34 may be actuated using a wireline or coiled tubing conveyed tooling.

Valve 10 may also have sensors 42, 44. Sensors 42, 44 are shown in FIG. 1 mounted within the sidewall of housing 12, but they may also be mounted in the interior region of housing 12 or on the exterior of housing 12. Sensors 42, 44 may be, for example, pressure or temperature gauges. Sensors 42 are preferably located above restrictor 28 and sensors 44 are preferably located below restrictor 28, meaning the measurements taken are from those respective regions. Sensors 42, 44 can take measurements from areas both inside and outside of housing 12 (i.e., tubing and annulus readings).

In operation, valve 10 is joined to tubing and run into a well in the configuration shown in FIG. 1. Lock 34 holds seal element 16 in its open state so well fluids can pass freely through valve 10 as it descends into the well.

Figure 2:
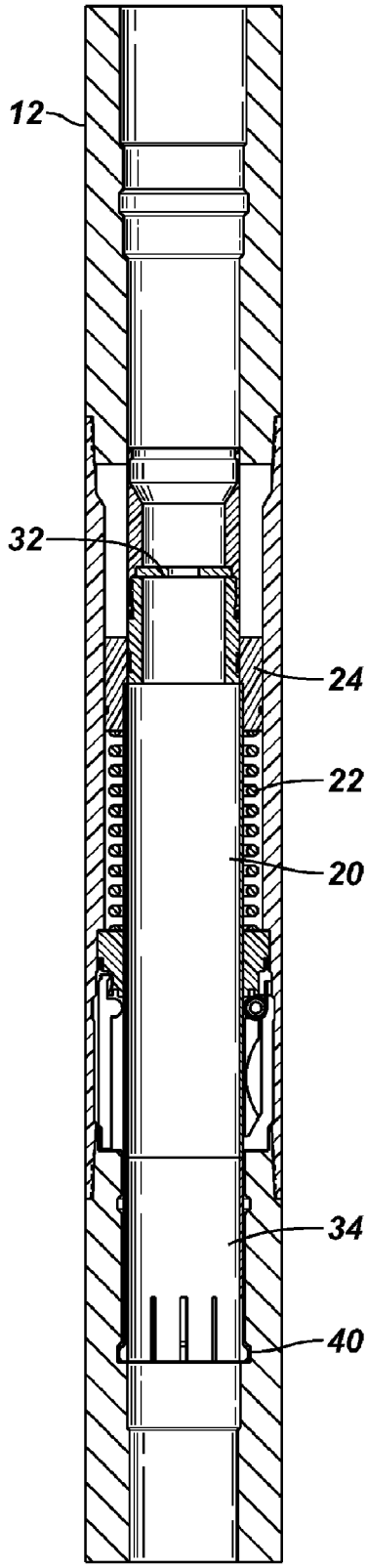
FIG. 2 is a schematic view of the valve of FIG. 1 shown in its open state.

FIG. 2 shows valve 10 when fluid is being injected into the well. Injected fluid is pumped through the tubing and enters restrictor 28 from above. Restrictor 28 creates a pressure differential across flow restriction 32. The pressure differential causes restrictor 28 to move downward, pushing flow tube 20 downward and thereby pushing lock 34 downward as well. Spring 22 is compressed as restrictor 28 moves downward. Upon sufficient travel, lock 34 moves clear of seal element 16 and collet 36 engages lower profile 40. Seal element 16 is held in its open state by flow tube 20.

Figure 3:
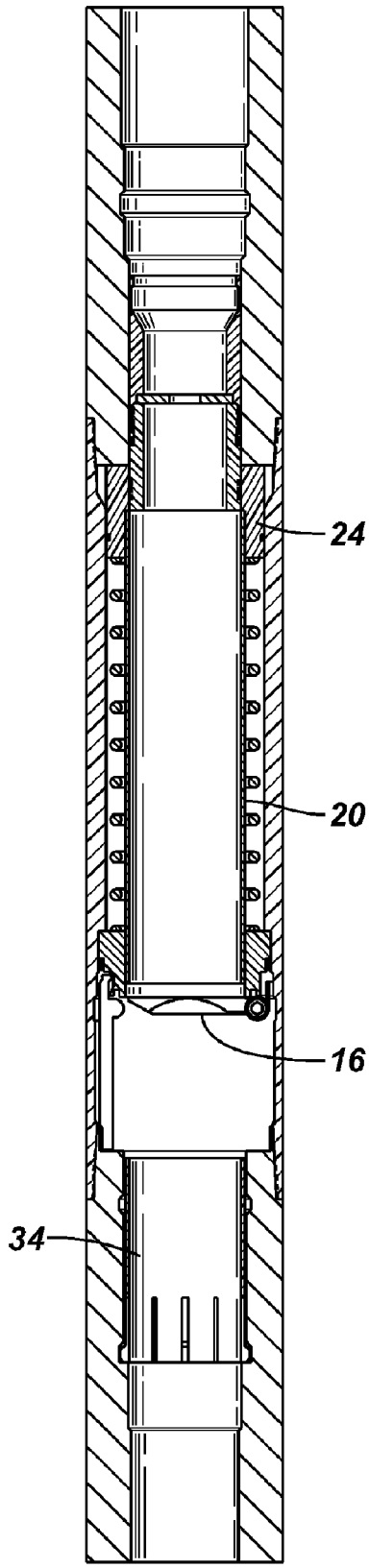
FIG. 3 is a schematic view of the valve of FIG. 1 shown in its closed state.

When injection operations cease, the pressure differential driving restrictor 28 to its lower position dissipates. As shown in FIG. 3, spring 22 returns to its natural or initial length, pushing flow tube 20 clear of seal element 16. Seal element 16 moves to its closed state, thereby blocking fluid flow upward through valve 10.

Because injection fluids are generally pumped through central passageway 18 at high velocities, flow restriction 32 may experience wear and change in size over time, reducing the differential pressure across flow restriction 32. If the differential pressure is lessened, then the driving force on restrictor 28 is also lessened. A change in injection requirements may also motivate replacement of restrictor 28. Restrictor 28 can be removed and replaced to maintain valve 10 in working order using conventional intervention methods such as through-tubing intervention.

Operation of valve 10 does not require the use of hydraulic control lines, though such lines could be run for other purposes, if desired. Also, electrical control lines or conduits may be used to communicate electrical signals to and from the surface. Use of such control lines or conduits would allow, for example, monitoring of well conditions and the operational status of valve 10.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A valve for use in a well comprising:

a housing having a central passageway therethrough;

a flow tube assembly having a restrictor disposed within the housing;

a seal element movably disposed in the housing; and a lock member initially locked to hold the seal element in an open position, wherein upon sufficient flow of fluid injected into the well through the restrictor the lock member is locked at a second position that enables movement of the seal element between the open position and a closed position.

2. The valve of claim 1 further comprising one or more sensors mounted to the housing.

3. The valve of claim 1 in which the restrictor has a flow restriction.

4. The valve of claim 3 in which the flow restriction is an orifice.

5. The valve of claim 3 in which the flow restriction is a narrowed passageway.

6. The valve of claim 1 in which the flow tube assembly further comprises:

a flow tube axially aligned with the central passageway and moveably mounted within the housing; and a spring carried on the flow tube between an upper shoulder mounted to the flow tube and a lower shoulder mounted to the housing.

7. The valve of claim 1 in which the restrictor is removeable.

8. The valve of claim 1 in which the seal element is a flapper.

9. The valve of claim 1 in which the housing has at least one end adapted to join to a tubing.

10. The valve of claim 1 in which the flow tube assembly moves or holds the seal element in its open state when a sufficient pressure differential is maintained across the restrictor, and moves oppositely to allow the seal element to move to its closed state when insufficient differential pressure is applied across the restrictor.

11. A flow tube assembly for use in a valve comprising:

a flow tube;

a spring carried on the flow tube between an upper shoulder mounted to the flow tube and a lower shoulder mounted to a housing of the valve;

a restrictor joined to the flow tube;

a seal element to selectively block fluid flow through the flow tube; and a lock member initially locked to hold the seal element in an open position, wherein upon sufficient flow of fluid injected into the well through the restrictor the lock member is locked at a second position that enables movement of the seal element between the open position and a closed position.

12. The flow tube assembly of claim 11 in which the restrictor is replaceable.

13. A method to inject fluids in a well comprising:

pumping fluid through a tubing and into a central passageway of a valve;

passing the fluid through a restrictor in the valve to create a pressure differential across the restrictor;

positioning a seal element for movement between an open state and a closed state with respect to the central passageway;

locking the seal element in the open state with a lock member; and moving a flow tube in response to the pressure differential created by fluid injected into the well to move the lock member to another locked position that enables the seal element to move between its open state and its closed state.

14. The method of claim 13 further comprising storing energy in a spring to provide a return force on the flow tube.

15. The method of claim 13 further comprising replacing the restrictor should the restrictor experience excessive wear.

16. The method of claim 13 further comprising relieving the pressure differential; allowing the flow tube to move clear of the seal element; and allowing the seal element to move to its closed state.

17. The method of claim 13 further comprising using sensors to monitor well conditions above the restrictor, below the restrictor, or both.

18. The method of claim 17 in which the well conditions include pressure, temperature, or both, in an annulus of the well or in the tubing.

19. A valve for use in a well comprising:

a housing having a central passageway therethrough;

a restrictor mounted within the housing;

a flow tube assembly disposed within the housing for movement upon a sufficient fluid flow through the restrictor;

a seal element moveably disposed in the housing; and a lock member movable by the flow tube assembly from a first lock position holding the seal element in an open state to a second lock position allowing the seal element to move between the open state and the closed state.

* * * * *